United States Patent [19]

Caudill

[11] Patent Number: 5,007,232

[45] Date of Patent: Apr. 16, 1991

[54] APPARATUS AND METHOD OF USE OF STERILIZING CONTAINERS USING HYDROGEN PEROXIDE VAPOR

[75] Inventor: Vance E. Caudill, Columbus, Ohio

[73] Assignee: Abbott Laboratories, Abbott Park, Ill.

[21] Appl. No.: 439,130

[22] Filed: Nov. 20, 1989

[51] Int. Cl.[5] ..... B65B 55/06; B65B 55/10; B65B 31/02

[52] U.S. Cl. ..... 53/426; 53/432; 53/469; 53/167; 53/510; 422/28; 426/399; 141/63; 141/85

[58] Field of Search ..... 53/425, 426, 167, 467, 53/469, 477, 432, 510, 373; 422/28, 32; 426/399, 400, 401, 407, 316; 141/63, 64, 85

[56] References Cited

U.S. PATENT DOCUMENTS

| | | | |
|---|---|---|---|
| 3,486,295 | 12/1969 | Rausing et al. | 53/426 X |
| 3,566,575 | 3/1971 | Lisiecki | 53/426 |
| 3,694,997 | 10/1972 | Christine et al. | 53/167 X |
| 4,424,189 | 1/1984 | Hick | 422/28 X |
| 4,680,163 | 7/1987 | Blidschun et al. | 422/28 |
| 4,734,268 | 3/1988 | Redding et al. | 422/28 X |
| 4,742,667 | 5/1988 | Müller et al. | 53/425 X |
| 4,896,478 | 1/1990 | Reiter | 53/426 |

*Primary Examiner*—Horace M. Culver
*Attorney, Agent, or Firm*—Donald O. Nickey; Lonnie R. Drayer; E. H. Gorman

[57] ABSTRACT

A method and apparatus for sterilizing containers using hydrogen peroxide vapor is disclosed. The apparatus for aseptically filling a container comprises a housing, a source of liquid hydrogen peroxide, means for providing a flow of heated gas, means for causing the hydrogen peroxide to mix with the heated gas thereby vaporizing the hydrogen peroxide, means inside the housing for dispensing the vaporized hydrogen peroxide, the means for dispensing the vaporized hydrogen peroxide including means for dispensing the vaporized hydrogen peroxide into the container, fill tube means extending into the housing for dispensing product into the container, means within the housing for sealing the container, and means providing for the passage of the container between the interior and exterior of the housing. The method comprises the steps of providing a housing with means for providing the passage of the container between the interior and the exterior of the housing, introducing a container into the housing, dispensing vaporized hydrogen peroxide into the container, dispensing product into the container, and sealing the container.

14 Claims, 3 Drawing Sheets

87
80
16
85
19
15
90
49
53
105
52
89
103
50
18
92
108
145
101
185
20
100
160
142
110
96
111
107
95
147
146
97
144
35
56
22
30
112
113
10
181
31
17
39
46
40
44
73
38
45
65
42
167
169
67
33
68
36
25
63
25
69
132
70
61
60
25
130
99
58
98
27
28

APPARATUS AND METHOD OF USE OF STERILIZING CONTAINERS USING HYDROGEN PEROXIDE VAPOR

TECHNICAL FIELD

The present invention relates generally to sterilization, and more particularly, to a novel apparatus for carrying out a method whereby a container may be sterilized using hydrogen peroxide vapor.

BACKGROUND ART

In the processing of foods, generally there have been two approaches to the packaging of food product in a container. The first method utilizes retorting, whereby a food product is placed into a container, the container is sealed, and then the product and container are subjected to heat such that the product is sterilized. In the second method, a container is subjected to a sterilizing process prior to its receiving sterilized food product.

Conventional processes for sterilizing containers in which food stuffs are subsequently packaged include UV irradiation, treatment with a mixture of steam and air, and an aseptic technique in which the interior wall of the container is sprayed with liquid hydrogen peroxide and subsequently dried.

An example of an apparatus and method for sterilizing containers by means of treatment with steam is disclosed in U.S. Pat. No. 4,494,363 issued to Rica, et al. This method and apparatus for aseptically filling containers discloses an automatic, as opposed to manual, filling system.

Experience has shown peroxide to be a particularly reliable sterilizing agent for killing micro-organisms. The germicidal action of peroxide depends upon the formation of the hydrogen peroxide free radical and the formation of free oxygen. The free oxygen being formed during thermal decomposition of $H_2O_2$ and exhibits a particularly strong sterilizing affect at the moment of formation. The efficiency of the wet aseptic process is attributable to the liquid hydrogen peroxide being able to penetrate the cell walls of micro-organisms.

Since hydrogen peroxide is a chemical irritant, it is necessary to obtain residual levels of less than 0.5 ppm (parts per million) before contact with product. The removal of the peroxide is typically achieved by evaporation, and thus a wet aseptic process requires, subsequent to the spraying step, a heating step. For example, the apparatus for the aseptic packing of high acid food disclosed in U.S. Pat. No. 4,409,775 issued to Brody, et al. dries the container by drainage and evaporation.

However, under the best of circumstances, (i.e. with the finest nebulization) uniformity of droplet distribution is not always possible for the internal surface of a container. The inability to completely wet the surface of the container during peroxide spraying can be attributed to the fact that droplets form on the surface and unwetted areas remain between these droplets. As a result, the combined spraying and heating steps associated with the wet aseptic process may not result in absolute or complete sterilization of the entire internal surface of a container.

A process for sterilizing tub shaped containers utilizing hydrogen peroxide vapor is disclosed in U.S. Pat. No. 4,424,199 issued to Hick. The vaporization is preferably achieved by spraying the sterilizing agent onto a heating element which is positioned either in or immediately above the open top of the container. The apparatus is configured to preclude the presence of vapor outside the immediate environ of the container to be sterilized, as well as limiting sterilization to one specific configuration of container.

Another problem with aseptic technology is that it is important to find out how a product behaves when it is sterilized aseptically. It is also important to see how the proposed container, typically a plastic container, reacts during and after aseptic process sterilization. Currently, it is necessary to purchase a production piece of equipment dedicated to one type of container, one type of container size, one type of operation, and one type of product. These units typically cost well above $1,000,000 which constitutes a considerable investment in terms of basic research.

It is thus apparent that the need exists for an improved apparatus and method for aseptic packaging which permits an extremely effective microbial kill while being sensitive to operating costs. It is also apparent that the need exists for an improved research tool associated with aseptic process sterilization which permits research on aseptic process sterilization at a relatively minimal cost, with this research tool having the capability to evaluate multiple containers and multiple sterilization treatments.

DISCLOSURE OF THE INVENTION

There is disclosed an apparatus for aseptically filling a container, with the apparatus comprising a housing, a source of liquid hydrogen peroxide, means for providing a flow of heated gas, means for causing the hydrogen peroxide to mix with the heated gas thereby vaporizing the hydrogen peroxide, means inside the housing for dispensing the vaporized hydrogen peroxide for sterilizing the environ with the means for dispensing the vaporized hydrogen peroxide including means for dispensing the hydrogen peroxide into the container, fill tube means extending into the housing for dispensing product into the container, means within the housing for sealing the container, and means providing for the passage of the container between the interior and exterior of the housing.

The apparatus also includes means for dispensing a gas into the housing so as to create an air-over-pressure environment. The gas may be either an inert gas or air. The means providing for the passage of the container between the interior and exterior of the housing includes at least one translator port, such that the pressure within the housing is greater than the pressure within the translator port. The apparatus also includes means for transporting product and gas from inside the housing, comprising means for mixing the exhaust gas with water prior to flushing the gas and water mixture down a drain. The mixing of the heated gas and peroxide in the apparatus occurs prior to the vaporized hydrogen peroxide being dispensed, and the apparatus is portable.

There is also disclosed a method of aseptically filling a container, said method comprising the steps of providing a housing with means for providing the passage of the container between the interior and exterior of the housing, introducing a container into the housing, dispensing vaporized hydrogen peroxide into the container, dispensing a product into the container, and sealing the container. The dispensing of vaporized hydrogen peroxide into the container occurs at a first position, the dispensing of the product into the container occurs at a second position, and the sealing of the container occurs at a third position.

The method also includes the step of sterilizing the interior of the housing by dispensing a flow of vaporized hydrogen peroxide into the housing. The dispensing of vaporized hydrogen peroxide is the result of mixing liquid hydrogen peroxide with a flow of heated gas. The mixing permits the values associated with the rate of gas flow, gas temperature, rate of peroxide flow and peroxide temperature to be variable.

There is also disclosed a system for aseptically filling a container, the system comprising the combination of a container and an apparatus for filling the container, with the apparatus comprising a housing, a source of liquid hydrogen peroxide, means for providing a flow of heated gas, means for causing said hydrogen peroxide to mix with said heated gas thereby vaporizing the hydrogen peroxide, means inside the housing for dispensing the vaporized hydrogen peroxide with the means for dispensing the vaporized hydrogen peroxide including means for dispensing the vaporized hydrogen peroxide into the container, fill tube means extending into the housing for dispensing product into the container, means within the housing for sealing the container, and means providing for the passage of the container between the interior and the exterior of the housing. The system includes means for dispensing the vaporized hydrogen peroxide directly into the container and the mixing occurs prior to the vaporized hydrogen peroxide being dispensed. The heated gas may be either an inert gas or air, and the apparatus is portable.

The present invention provides an apparatus and method for the highly efficient, aseptic sterilization. At the same time, the present invention, due in part to its portability and flexibility, provides an excellent research tool. Other aspects and advantages of the invention will be apparent from the following description, the accompanying drawings, and the appended claims.

DETAILED DESCRIPTION OF THE INVENTION

Figure 1:
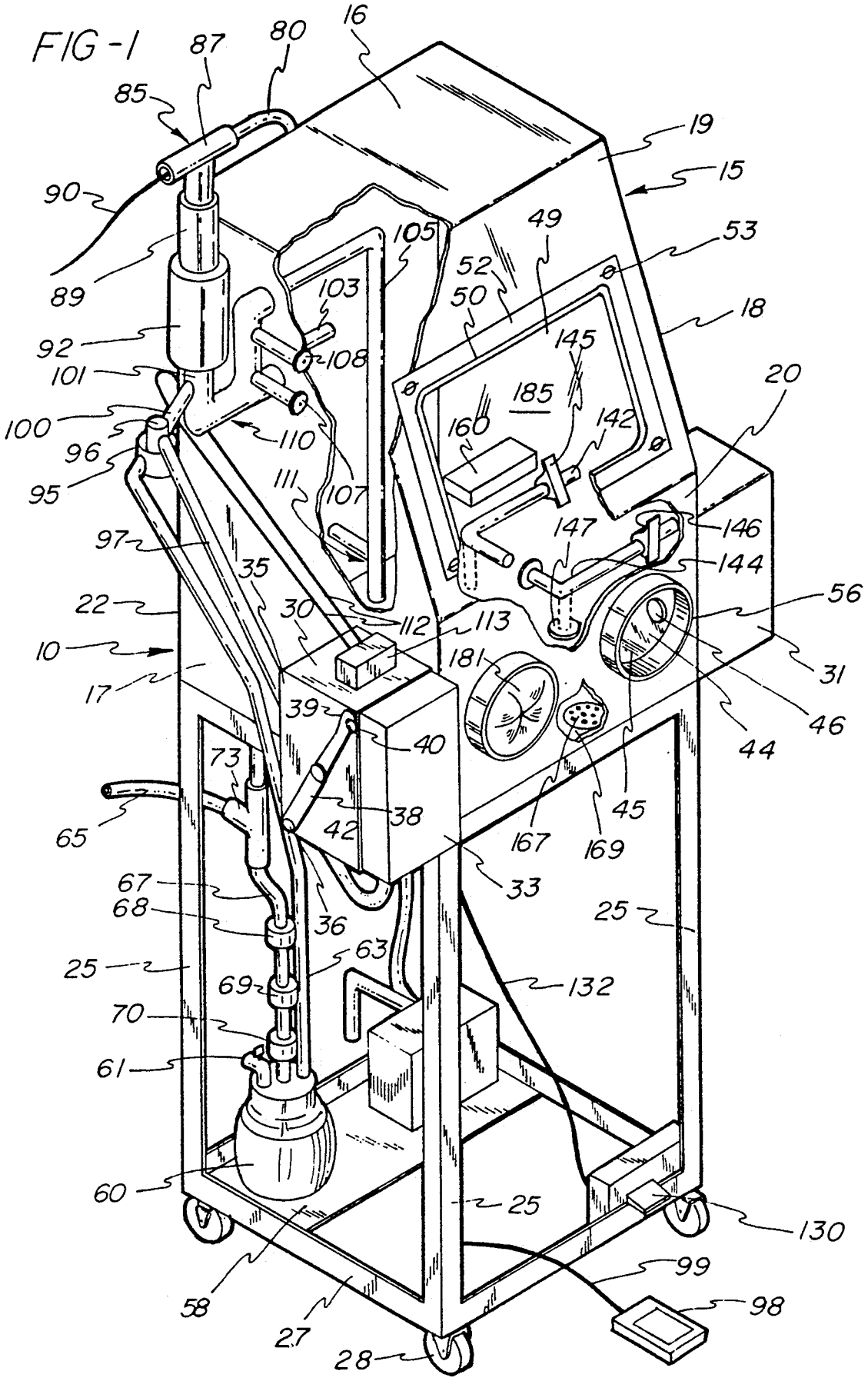
FIG. 1 is a perspective view of the aseptic process sterilization device in accordance with the present invention, with various parts of the view constituting cut-away views of the invention.

Having reference to the drawings, attention is directed first to FIG. 1 which illustrates an aseptic process sterilization device embodying this invention designated generally by the numeral 10. A basic component of this invention is a housing or glove box 15 having a top surface 16, side walls 17 and 18, an inclined front surface 19, a front wall 20, and a rear wall 22. The housing is positioned atop legs 25 which extend to a base 27. Wheels 28 or other suitable transport means permit the device of this invention to be portable. The housing 15, legs 25, and base 27 are all preferably fabricated from metal, with the glove box 15 resembling conventionally available glove boxes. Secured adjacent the exterior of side walls 17 and 18 are translator ports 30 and 31 respectively. Secured to the device, preferably to the front wall of translator port 30 as is shown in FIG. 1, is a micro-controller 33, of the type which is also commercially available.

Figure 2:
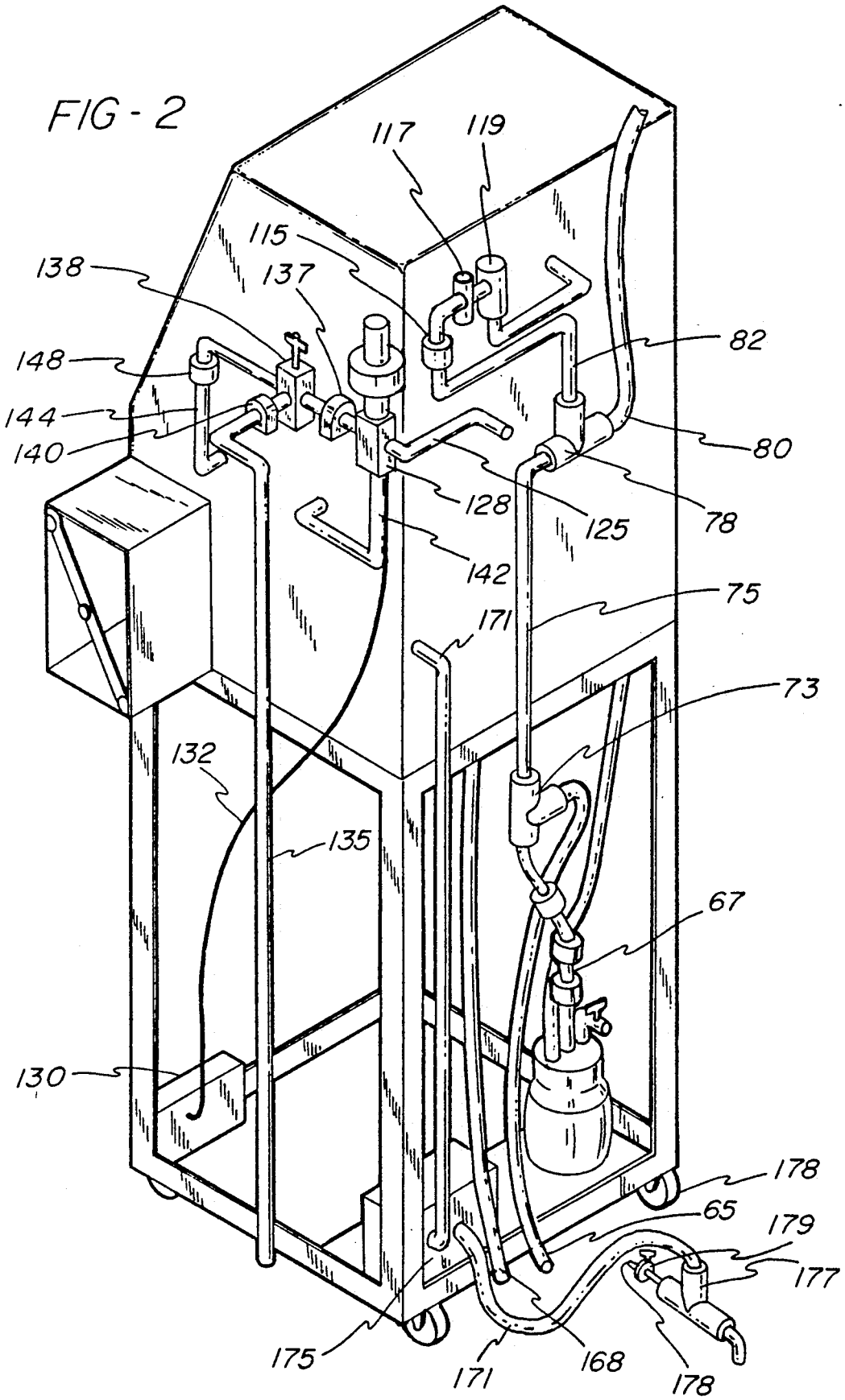
FIG. 2 is a perspective view taken from the rear of the present invention.

As can be seen in FIGS. 1 and 2, translator ports 30 and 31 both comprise exterior doors 35 which rotate about a pivot 36, with closure being affected when each door's respective crossbar 38 has its hooked portion 39 encircling retaining means 40. An adjustable control knob 42 is secured to each of the crossbars 38 and is adjustable preferably by screw threaded means with respect to the distance between each of the adjustable control knobs 42 and its respective exterior door 35. Thus for example, when the adjustable control knob is loosened, the hooked portion 39 of crossbar 38 may be readily removed from its closed position adjacent retaining means 40.

An interior door 44, preferably one which slides within tract 45 is provided for use in conjunction with each of translator ports 30 and 31. Each of the interior doors 44 have a knob 46 located within housing 15 to permit access from within housing 15 into each of the respective translator ports 30 and 31.

As can be seen in FIG. 1, the aseptic process sterilization device in its preferred embodiment includes a glass window 49 in the inclined front surface 19, with the glass being surrounded by a gasket 50. The glass 49 may also be covered with an additional translucent sheet panel 52 designed to shield against ultra violet radiation, with this panel 52 being secured to the inclined front surface 19 of housing 15 by fastening means 53. Glove ports 55 and 56 are located along front wall 20 and are of sufficient diameter to readily accommodate the forearm of an individual using the apparatus of this invention.

As can be seen in both FIGS. 1 and 2, a shelf 58 transverses base 27 beneath the rear portion of the housing. Positioned on shelf 58 is a peroxide source 60 shown in the preferred embodiment as comprising a tank containing liquid hydrogen peroxide of a concentration of approximately 35% by weight. The peroxide source 60 is disclosed as having a pressure relief valve 61 to deal with excessive pressure which theoretically could be generated within the tank 60.

Figure 3:
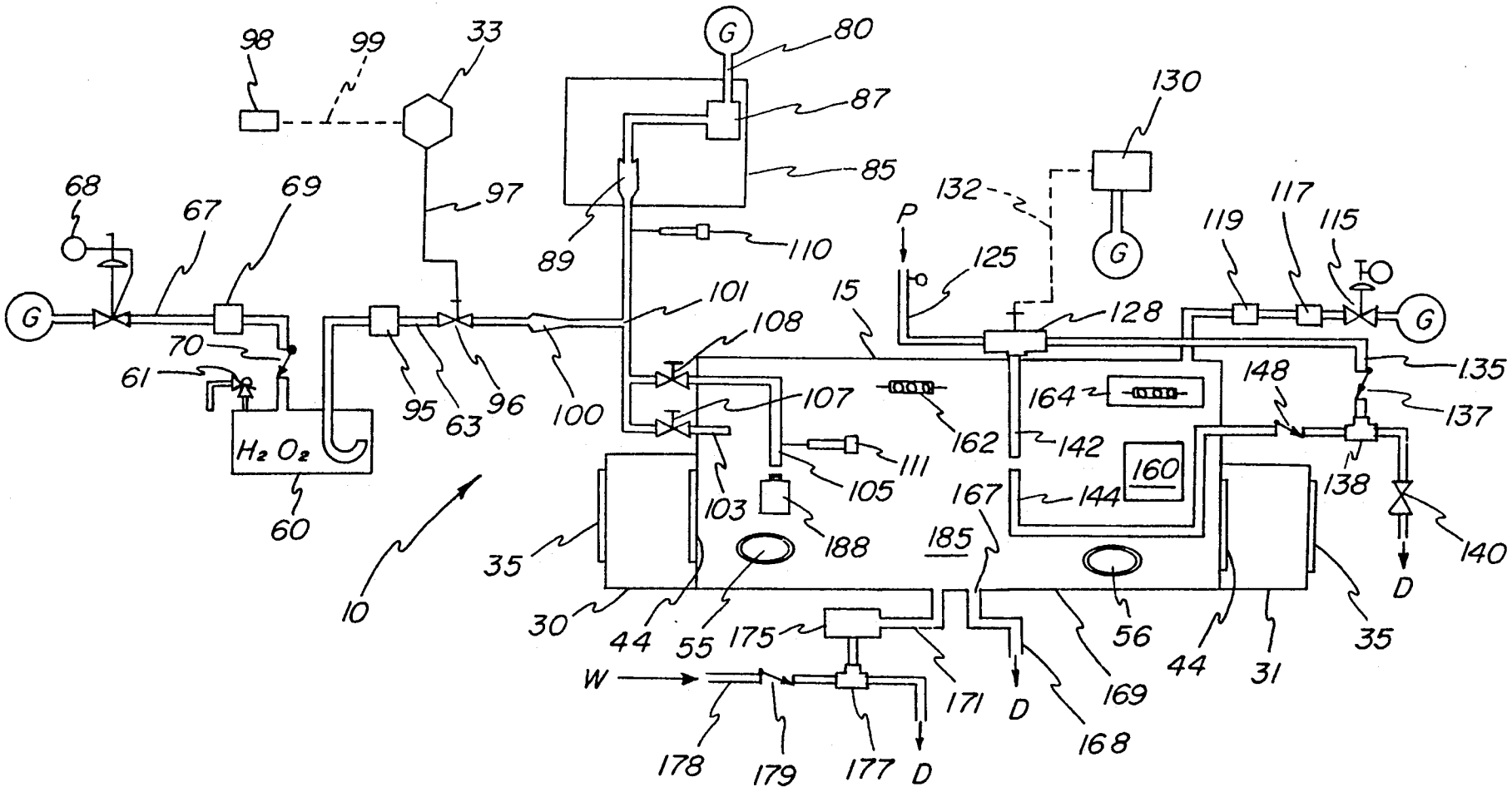
FIG. 3 is an illustration in diagrammatic form of the apparatus useful in carrying out the invention.

As can be seen in FIGS. 1–3, peroxide line 63 extends upwardly from peroxide source 60 with its lower most portion extending near the bottom of the tank. The peroxide is forced into the peroxide line 63 by gas pressure originating with main gas conduit 65. The main gas conduit 65 is connected to a source of pressurized gas, with this gas either being an inert gas or air. The main gas conduit has one branch which is a first gas conduit 67. The gas which passes through first gas conduit 67 passes through a pressure regulator gauge 68, an air filter 69, and a check valve 70 prior to entering tank 60.

The main gas conduit 65 branches into the first gas conduit 67 at a connector 73, where it also branches into second gas conduit 75. Second gas conduit 75 thereafter branches at connector 78 into a third gas conduit 80 and a fourth gas conduit 82. The third gas conduit 80 connects to a controlled gas source 85 comprising a variable gas flow blower 87 and heater 89. Electric power for the variable air flow blower 87 and heater 89 is provided by means of an electric conduit 90 which is connected to an appropriate source of electricity.

The gas which has flowed through third gas conduit 80 is blown and heated prior to its passing into an insulated conduit 92. The insulated conduit 92 may incorporate an appropriate high temperature insulation. The hydrogen peroxide from peroxide source 60 passes through peroxide line 63 and into a peroxide filter 95 and thence through a solenoid or other pneumatic or remote controlled valve 96. The peroxide filter 95, filters out particles up to 0.15 microns in size, such that the peroxide is relatively particulate free. The solenoid of this invention is connected to micro-controller 33 by means of a micro-controller conduit 97. Foot switch 98 with its circuitry 99, is used to energize the solenoid, which in this invention permits the peroxide to be dosed via atomizing nozzle 100 in an atomized spray. The length of time that the solenoid is open can be preset to range from 1–1,000 milliseconds but preferably is approximately 20 milliseconds, and most preferably is 17 milliseconds.

The atomized spray of hydrogen peroxide from the atomizing nozzle 100 is thrust through a vortex into an area of the insulated conduit 92 where it passes into the flow of heated gas in mixing chamber 101. The mixing permits the values associated with the rate of gas flow, gas temperature, rate of peroxide flow and peroxide temperature to be variable. As the peroxide is misted into the stream of heated gas, the peroxide is vaporized. Although 100% hydrogen peroxide vapor presents the danger of explosion, the presence of water in the diluted composition utilized in this invention renders the peroxide non-explosive. Since the lethality of peroxide to micro-organisms is directly proportional to its temperature, the temperature of the peroxide should be high enough to result in phenomenal killing, with values approximating $10^6$ for misting for 0.2 seconds and up to $10^8$ for misting of approximately 1 second.

After the hydrogen peroxide is vaporized, the hydrogen peroxide vapor may either flow in a heavy stream from peroxide dispensing means 103 into the interior of the housing 15, or through containerized dispensing means 105, as can be seen in FIGS. 1 and 3. Peroxide dispensing means 103 has associated therewith a first dispensing means valve 107 which controls the flow of the heated peroxide vapor through the peroxide dispensing means. A second dispensing means valve 108 is associated with the containerized dispensing means 105 and controls the flow of peroxide through that particular conduit. The conduit associated with the hydrogen peroxide, i.e. peroxide line 63, the mixing chamber 10, the peroxide dispensing means 103 and the containerized dispensing means 105 all must be fabricated from materials which are resistant to hydrogen peroxide and high temperatures. In addition to stainless steel, other possible compositions include silicon or Viton TM (E.I. DuPont de Nemours & Co.) rubber.

Sensor 110 is placed in the flow of heated gas in an area of the insulated conduit between the heater 89 and the mixing chamber 101 as can be seen in FIG. 3. A second sensor 111 is placed in contact with the hydrogen peroxide vapor as it passes through containerized dispensing means 105. The two sensors are connected by means of sensor circuitry 112 to a sensor readout 113 located in the preferred embodiment atop translator port 30. Sensor readout 113 permits the temperatures of the heated gas and the heated hydrogen peroxide vapor to be compared for purposes of controlling the temperatures and flow rates of both the peroxide and the heated gas, so as to maintain the desired degree of lethality.

Turning to FIGS. 2 and 3, the gas which passes through the fourth gas conduit 82 flows through pressure regulator valve 115 and thence into prefilter 117 which is capable of filtering out particles of a size down to 5 microns. The gas then passes through an absolute filter 119 which filters out particles down to 0.2 microns in size. The relatively absolute gas then enters the interior of the housing by passing through an opening near the top of rear wall 22 as shown in FIG. 2.

The food product associated with this invention originates in product feed line 125. The product passes into a filler, also known as a multiple valve 128, which is controlled by a foot switch or pneumatic impulse controller 130. The filler is connected to the pneumatic impulse controller 130 by means of foot switch circuitry 132. The filler is of the type in which air pressure energizes a spring loaded piston thereby permitting the redirection of flow through multiple valve 128.

Product exhaust line 135 has therein a check valve 137 and a three-way valve 138. Product which passes through check valve 137 and three-way valve 138 then flows to drain D through a back pressure valve 140 which restricts the flow through the system somewhat, thereby building up pressure. The main purpose for this pressure as will be described below relates to the sterilization of the system prior to the introduction of product therein.

In actual operation, the food product passes through product dispensing conduit 142 which is located in the interior of the housing. Also located in the interior of the housing is connecting conduit 144, with fill tube 142 and connecting conduit 144 having associated therewith pivot means 145 and 146 respectively. Pivot means 145 and 146 permit the rotation of fill tube means 142 and connecting conduit 144, such that they may be joined by connecting means 147 to form a continuous conduit from valve 128 through check valve 148, three-way valve 138, and back pressure valve 140 to the drain D.

The portable aseptic process sterilization device of this invention may be connected to an existing processing system. Prior to introduction of food product into the system product dispensing conduit 142 and connecting conduit 144 are secured to each other by means of connecting means 147. Heated water is then introduced into product feed line 125. As the temperature of the water is increased, so is the temperature of the conduit itself. Through the use of back pressure valve 140 and the oscillating action associated with multiple valve 128 as acted upon by the pneumatic impulse controller 130, the entire conduit through which product ultimately will pass may be sterilized. During the sterilization of the product feed line 125, the product dispensing conduit 142, the connecting conduit 144, and the product exhaust line 135, the water temperature preferably exceeds 250° F. (121° C.).

To assist in the sterilization of the food product lines, an air-over-pressure environment is created. Air brought in through gas conduit 82 results in a slightly positive force, such that all air or gas flows from chamber 185 outwardly, with this air or gas being sterile due to the presence of peroxide vapor. The pressure within the housing is greater than the pressure within the translator ports. The air-over-pressure environment results in an air change within the glove box approximately 4 times a minute, thereby maintaining the sterility of the system over a continuous period of time.

A heat exchanger which is part of typical processing systems cools the heated water which has been passing through product feed line 125 down to approximately 7O° F. (21° C.). The substitution of the cooler water results in the product feed line, product dispensing conduit, connecting conduit, and product exhaust line also being cooled to approximately 70° F. (21° C.). At this lower temperature the fill tubes means 142 and connecting conduit 144 are disconnected and the fill tube means is rotated into position for the dispensing of product. Excess water then drains from the connecting conduit 144.

The introduction of product P into the product feed line 125 with the multiple valve 128 positioned to permit flow through filler 128 and product exhaust line 135 to drain D, also permits water to drain from fill tube means 142. Alternatively, the product which flows through back pressure valve 140 during the actual operation of this invention could be recycled to a blending kettle. The product P which is then flowing through product feed line 125 is sterile product which may be dispensed into chamber 185 upon activation of the pneumatic impulse controller 130. Other important components of the invention which are desirable for inclusion in the system are a conventional heat sealer 160 secured to the interior of side wall IB, a UV light 162 secured to an upper portion of the housing for use in sterilization via irradiation, and a fluorescent light 164 preferably located above the heat sealer 160 to assist in the sealing of containers once they have been sterilized and filled with product. The presence of heat sealer 160 within glove box 15 permits the container to be heat sealed within the system. Typically the heat sealer 160 comprises a heated plate. A foil cap is placed o top of the container and upon being brought into contact with heat sealer 160 is secured to the container.

A product exhaust drain 167, from which product exhaust conduit 168 depends downwardly to drain D, is included in the bottom 169 of housing 15. A corresponding gas exhaust 171 is shown in FIG. 2 as being located in the lower portion of rear wall 22 and extending downwardly to vacuum pump 175 which is also located on shelf 58. The exhaust drain is elevated so that the air or gas can be exhausted at a constant rate. The gas which flows through vacuum pump 175 then passes through an aspirator 177 associated with water conduit 178 having therein check valve 179. The gas exhaust and water mixture flow from aspirator 177 to drain D. A pair of rubber gloves 181 are secured to glove ports 55 and 56 in actual operation of the system such that as shown in FIG. 1 with respect to glove port 55, the finger portion of rubber glove 181 is physically located inside chamber 185.

BEST MODE

In actual operation, the apparatus has its various conduits sterilized as disclosed above and the apparatus is connected to the various gas G and product P sources. The translator ports provide the housing with means for providing the passage of a container between the interior and the exterior of the housing. Preferably prior to introduction of a container into the chamber, a heavy flow of vaporized hydrogen peroxide is dispensed into the housing by means of peroxide dispensing means 103.

A container is then introduced into the chamber via at least one of the translator ports, preferably translator port 30. Activating the solenoid 96 associated with micro computer 33 by means of foot switch 98 causes a slight amount of hydrogen peroxide to be dosed through atomizing nozzle 100 into mixing chamber 101 where it comes in contact with a flow of heated gas which has passed through variable gas flow blower 87 and heater 89. The mixing occurs prior to the vaporized hydrogen peroxide being dispensed.

The misted hydrogen peroxide then becomes vaporized and is passed through dispensing means 105 and into contact with container 188. When the vaporized hydrogen peroxide comes into contact with container 188, the vapor condenses and then almost immediately is evaporated due to the heat and amount of liquid actually present. The residual peroxide is usually at a concentration of less than 0.5 ppm within a few seconds after introduction. The higher lethality associated with vaporized hydrogen peroxide permits the use of less peroxide since due to the elevated temperature there is a rapid kill. The tremendous lethality associated with this invention has been confirmed by micro tests.

This dispensing of peroxide occurs at a first position within the housing or chamber. In accordance with this invention, the container then is transported preferably manually to a second position where product is dispensed into the container. The container is then transported yet again to a third position at which position the container is sealed, preferably by heat sealing.

INDUSTRIAL APPLICABILITY

The food processing industry has long sought to provide an efficient and cost-effective means of sterilization, especially through the use of the aseptic process. Additionally the industry has sought ways to reduce the cost associated with research as to the practicality of specific aseptic process sterilizations. This invention solves those long-felt needs. A portable manual system such as disclosed by this invention can be manufactured for a fraction of the cost typically associated with aseptic sterilization systems. The advantages of this invention would be found extremely beneficial in the food processing industry.

The system and method of this invention permits the sterilization of containers such that research can be conducted into how a food product behaves under aseptic conditions. Additionally, this system permits relatively inexpensive research to be conducted with respect to aseptic process sterilization's reaction with a specific container, typically plastic ones. The apparatus of this invention is not restricted to the shape, size, or composition of container or the specific food product. Additionally, the temperature and flow associated with both the peroxide and the heated gas are variable. This is especially important since different containers have different bioburdens.

While the form of apparatus and method herein described constitute a preferred embodiment of this invention, it is to be understood that the invention is not limited to this precise form of apparatus or method and that changes may be made therein without departing from the scope of the invention which is defined in the appended claims.

What is claimed is:

1. Apparatus for aseptically filling a container, said apparatus comprising:

a housing, a source of liquid hydrogen peroxide, means for providing a flow of heated gas, means for causing said hydrogen peroxide to mix with said heated gas, the mixing thereby vaporizing said hydrogen peroxide, means inside said housing for dispensing the vaporized hydrogen peroxide, said means for dispensing said vaporized hydrogen peroxide including means for dispensing said vaporized hydrogen peroxide into said container, fill tube means extending into said housing for dispensing product into said container, means within said housing for sealing said container, and means providing for the passage of said container between the interior and the exterior of said housing.

2. The apparatus as claimed in claim 1 which includes means for dispensing air into said housing so as to create an air-over-pressure environment.

3. The apparatus as claimed in claim 1 wherein said means for dispensing said vaporized hydrogen peroxide includes means for dispensing said vaporized hydrogen peroxide directly into said container.

4. The apparatus as claimed in claim 1 wherein said mixing occurs prior to the vaporized hydrogen peroxide being dispensed.

5. The apparatus as claimed in claim 2 wherein said means providing for the passage of said container between the interior and the exterior of said housing includes at least one translator port, such that the pressure within said housing is greater than the pressure within said translator port.

6. The apparatus as claimed in claim 1 wherein said heated gas is an inert gas.

7. The apparatus as claimed in claim 1 wherein said heated gas is air.

8. A method of aseptically filling a container, said method comprising the steps of providing a housing with means for providing the passage of said container between the interior and the exterior of said housing, said housing comprising a compartment, introducing a container into said compartment, mixing hydrogen peroxide with heated air to form a vapor, thereafter directly dispensing said vaporize hydrogen peroxide into said container, dispensing product into said container, and heat sealing said container.

9. The method as claimed in claim 8 wherein said dispensing vaporized hydrogen peroxide into said container occurs at a first position, said dispensing product into said container occurs at a second position, and said heat sealing said container occurs at a third position, said first, second and third positions all being in the same compartment.

10. The method as claimed in claim 8 which includes the step of sterilizing the interior of said compartment by dispensing a flow of vaporized hydrogen peroxide into said compartment.

11. The method as claimed in claim 8 wherein said dispensing of vaporized hydrogen peroxide is the result of mixing liquid hydrogen peroxide with a flow of heated gas.

12. The method as claimed in claim 11 wherein said mixing permits the values associated with rate of gas flow, gas temperature, rate of peroxide flow and peroxide temperature to be variable.

13. An apparatus for aseptically filling a container, said apparatus comprising:

a housing, said housing comprising a compartment, a source of liquid hydrogen peroxide, means for providing a flow of heated gas, means for causing said hydrogen peroxide to mix with said heated gas, the mixing thereby vaporizing said hydrogen peroxide, means inside said compartment for dispensing the vaporized hydrogen peroxide, said means for dispensing said vaporized hydrogen peroxide including means for dispersing said vaporized hydrogen peroxide into said container, fill tube means extending into said compartment for dispensing product into said container, means within said compartment for heat sealing said container, and means providing for the passage of said container between the interior and the exterior of said housing.

14. The apparatus as claimed in claim 13 wherein said vaporized hydrogen peroxide passes directly from said mixing means to said compartment.

* * * * *

UNITED STATES PATENT AND TRADEMARK OFFICE

CERTIFICATE OF CORRECTION

PATENT NO. : 5,007,232

DATED : April 16, 1991

INVENTOR(S) : Vance E. Caudill

It is certified that error appears in the above-identified patent and that said Letters Patent is hereby corrected as shown below:

Claim 8, line 8, "vaporize" should be --vaporized--

Signed and Sealed this

First Day of September, 1992

*Attest:*

DOUGLAS B. COMER

*Attesting Officer*

*Acting Commissioner of Patents and Trademarks*